US010865981B1

(12) United States Patent
Petrollini

(10) Patent No.: US 10,865,981 B1
(45) Date of Patent: Dec. 15, 2020

(54) CEILING FAN LIGHT ATTACHMENT APPARATUS

(71) Applicant: Robert Petrollini, Fort Meyers, FL (US)

(72) Inventor: Robert Petrollini, Fort Meyers, FL (US)

( * ) Notice: Subject to any disclaimer, the term of this patent is extended or adjusted under 35 U.S.C. 154(b) by 0 days.

(21) Appl. No.: 16/866,635

(22) Filed: May 5, 2020

(51) Int. Cl.

| | |
|---|---|
| ***A47B 23/06*** | (2006.01) |
| ***F21V 33/00*** | (2006.01) |
| ***F21V 23/04*** | (2006.01) |
| ***F21V 15/01*** | (2006.01) |
| *F21Y 115/10* | (2016.01) |

(52) U.S. Cl.
CPC ..... *F21V 33/0096* (2013.01); *F21V 15/01* (2013.01); *F21V 23/0435* (2013.01); *F21Y 2115/10* (2016.08)

(58) Field of Classification Search
CPC .. F21V 33/0096; F21V 15/01; F21V 23/9435; F21Y 2115/10
USPC ..... 362/127
See application file for complete search history.

(56) References Cited

U.S. PATENT DOCUMENTS

| | | | | |
|---|---|---|---|---|
| 5,028,206 | A | 7/1991 | Kendregan | |
| 5,270,905 | A * | 12/1993 | Trevino | F21V 33/0096 277/651 |
| 5,437,540 | A | 8/1995 | Blocker | |
| 6,036,331 | A * | 3/2000 | Acquisto | F04D 29/005 362/96 |
| 7,318,701 | B2 | 1/2008 | Farmer | |
| D672,027 | S | 12/2012 | Williams | |
| D710,489 | S | 8/2014 | Shurtleff | |
| 10,465,860 | B2 * | 11/2019 | Powell | F21K 9/278 |
| 2006/0120064 | A1 | 6/2006 | McElhannon | |
| 2007/0009357 | A1 | 1/2007 | Solak | |
| 2007/0166148 | A1 | 7/2007 | Middleton | |
| 2009/0297345 | A1 | 12/2009 | Crace | |
| 2015/0176834 | A1 * | 6/2015 | Avedon | F21V 29/677 415/121.3 |
| 2016/0363313 | A1 * | 12/2016 | Wang | F21V 33/0096 |
| 2017/0321878 | A1 * | 11/2017 | Yao | F21V 33/0096 |
| 2019/0032912 | A1 * | 1/2019 | Xie | G06F 1/20 |
| 2019/0323524 | A1 * | 10/2019 | Jackson | B01D 46/44 |
| 2019/0346130 | A1 * | 11/2019 | Lin | G02B 6/0088 |

* cited by examiner

*Primary Examiner* — Ali Alavi

(57) ABSTRACT

A ceiling fan light attachment apparatus for improved illumination from a ceiling fan includes a light housing having an annular housing bottom side, a housing inner wall perpendicularly extending up from an inner diameter of the housing bottom side, and a housing outer wall perpendicularly extending up from an outer diameter of the housing bottom side defining a housing inside. The housing inner wall attaches to a ceiling fan between a hub and a fan light of the ceiling fan. A plurality of light blades is coupled to the light housing. A plurality of LED lights is coupled to a blade underside of each light blade and is in operational communication with a power supply.

10 Claims, 7 Drawing Sheets

CEILING FAN LIGHT ATTACHMENT APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to ceiling fan light devices and more particularly pertains to a new ceiling fan light device for improved illumination from a ceiling fan.

(2) Description of Related Art Including Information Disclosed Under 37 CFR 1.97 and 1.98

The prior art relates to ceiling fan light devices. Existing devices either replace existing fan lights or attach to the light blades. Replacement lights can be brighter but do not add supplemental light, while lights attached to the light blades move when the fan is on and may produce an undesirable strobe effect. What is needed, and what the present invention provides, is a supplemental lighting device that is attachable to the fan above the existing fan light without being attached to the light blades.

BRIEF SUMMARY OF THE INVENTION

An embodiment of the disclosure meets the needs presented above by generally comprising a light housing having an annular housing bottom side, a housing inner wall perpendicularly extending up from an inner diameter of the housing bottom side, and a housing outer wall perpendicularly extending up from an outer diameter of the housing bottom side defining a housing inside. The housing inner wall is configured to attach to a ceiling fan between a hub and a fan light of the ceiling fan. A plurality of light blades is coupled to the light housing. Each light blade radially extends from an outer diameter of the housing bottom side. A power supply is coupled to the light housing within the housing inside. A control switch is coupled to the light housing is being in operational communication with the power supply. A plurality of LED lights is coupled to the plurality of light blades. The LED lights are coupled to a blade underside of each light blade and are in operational communication with the power supply.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
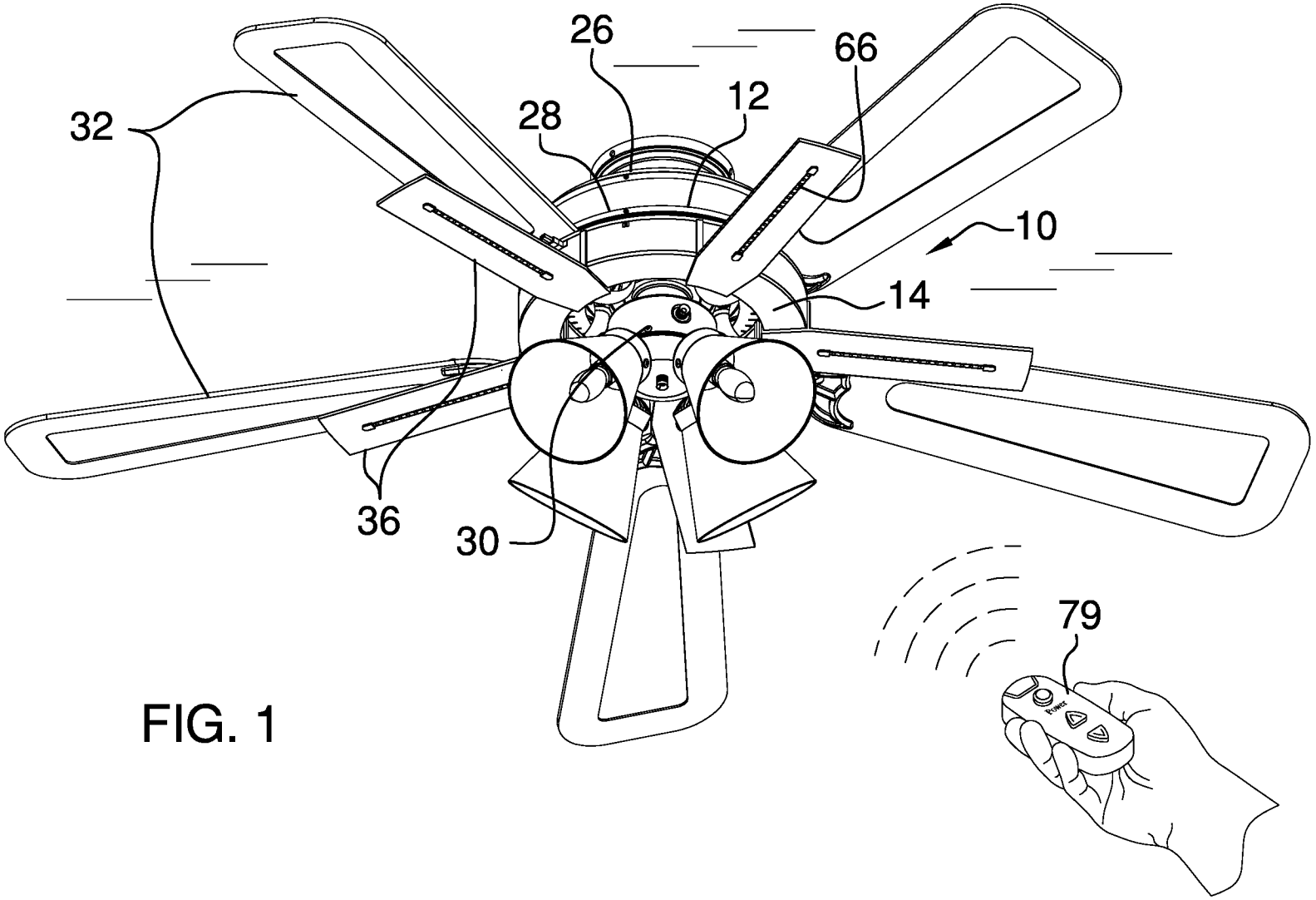
FIG. 1 is an isometric view of a ceiling fan light attachment apparatus according to an embodiment of the disclosure.
Figure 2:
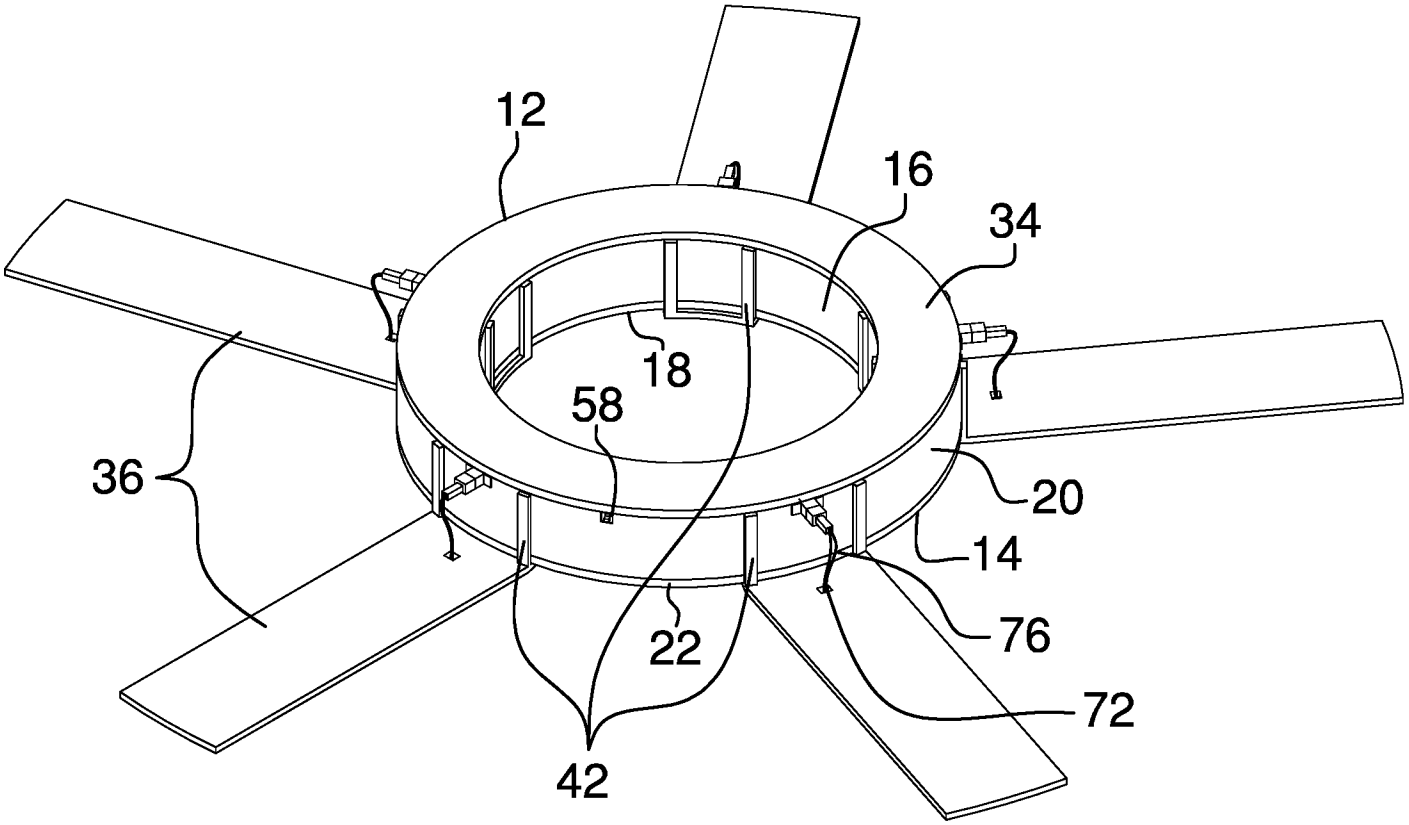
FIG. 2 is an isometric view of an embodiment of the disclosure.
Figure 3:
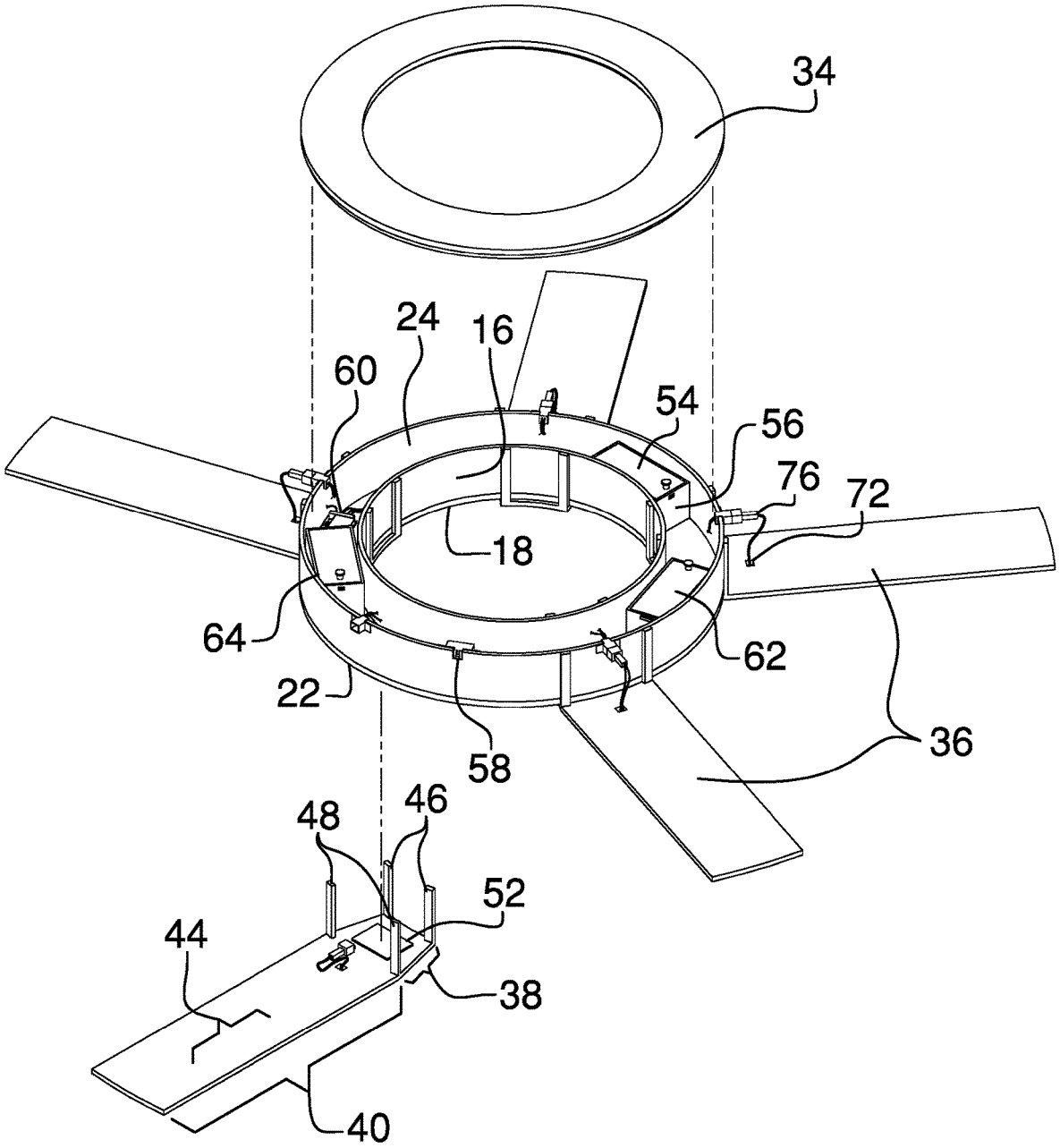
FIG. 3 is an exploded view of an embodiment of the disclosure.
Figure 4:
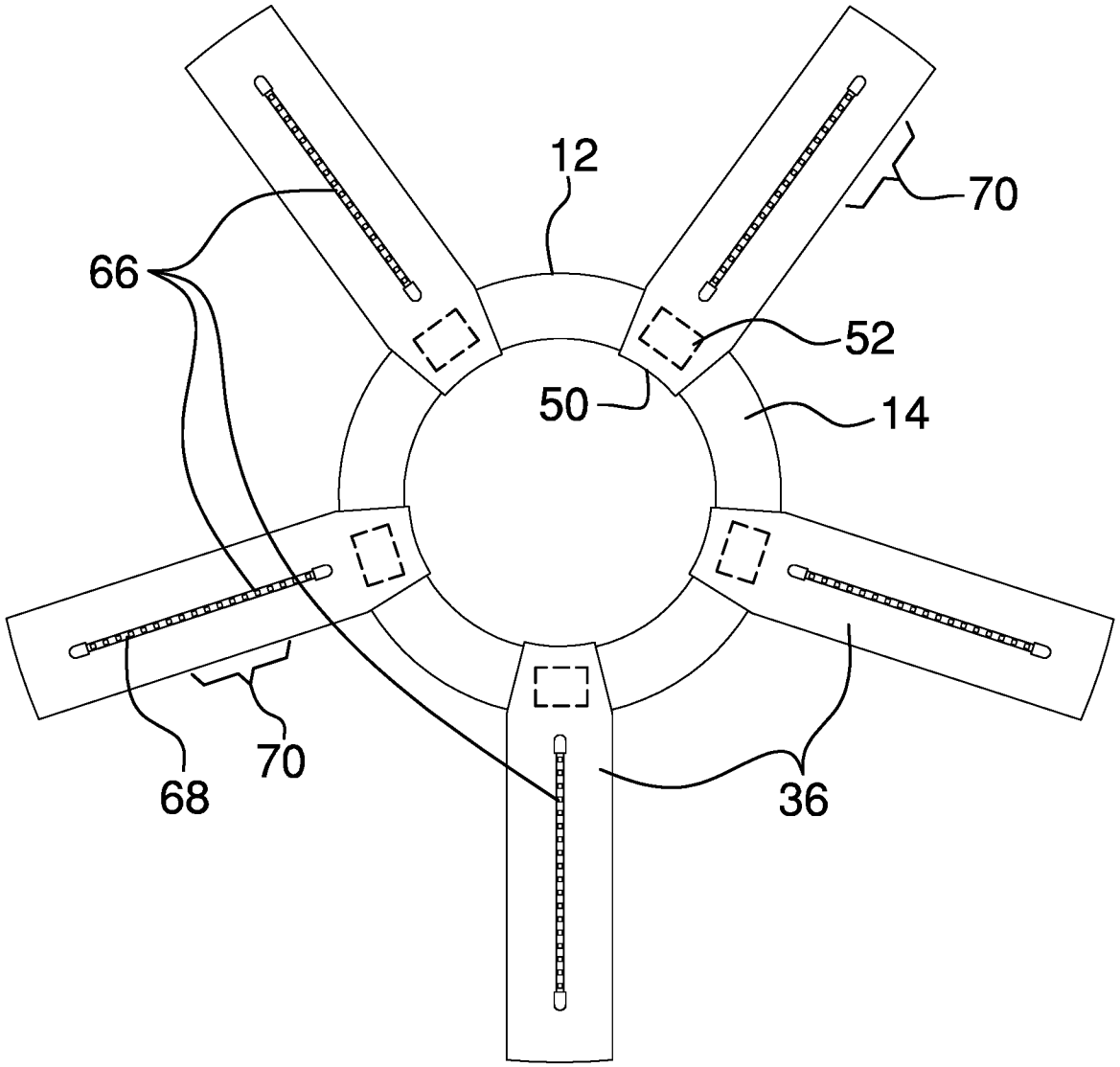
FIG. 4 is a bottom plan view of an embodiment of the disclosure.
Figure 5:
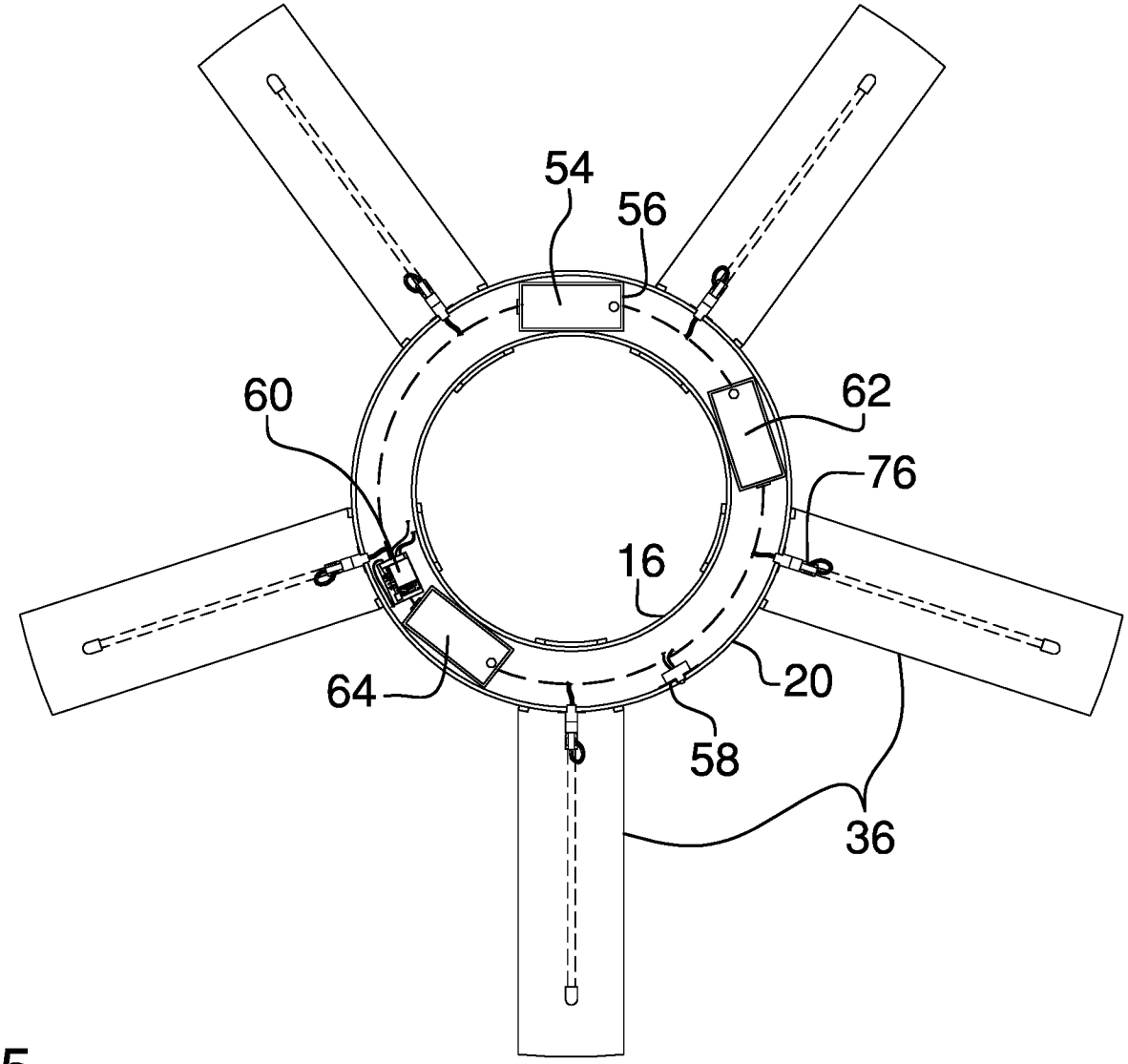
FIG. 5 is a top plan view of an embodiment of the disclosure.
Figure 6:
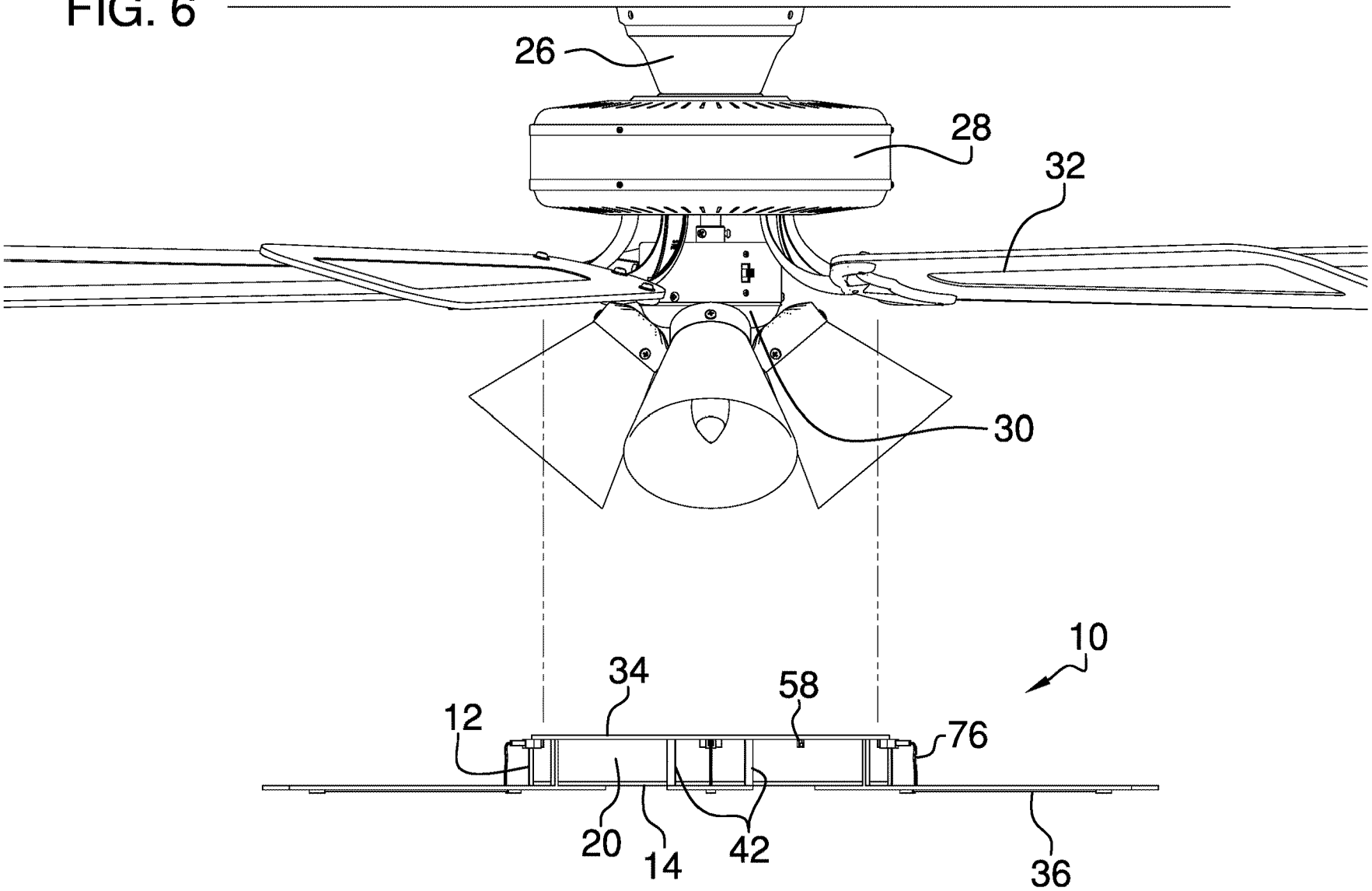
FIG. 6 is a side elevation view of an embodiment of the disclosure.
Figure 7:
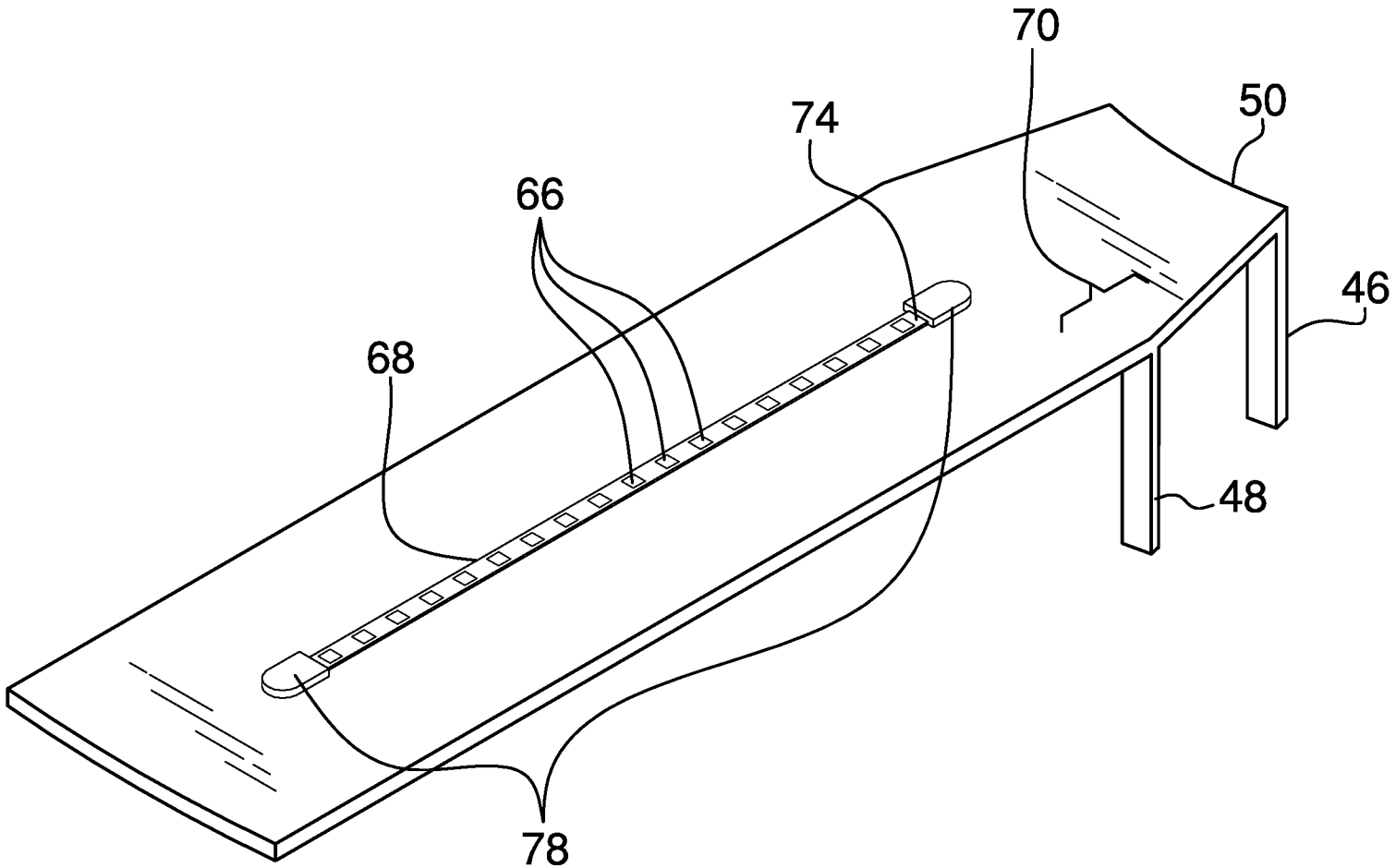
FIG. 7 is a detail view of an embodiment of the disclosure.

With reference now to the drawings, and in particular to FIGS. 1 through 7 thereof, a new ceiling fan light device embodying the principles and concepts of an embodiment of the disclosure and generally designated by the reference numeral 10 will be described.

As best illustrated in FIGS. 1 through 7, the ceiling fan light attachment apparatus 10 generally comprises a light housing 12 having an annular housing bottom side 14, a housing inner wall 16 perpendicularly extending up from an inner diameter 18 of the housing bottom side 14, and a housing outer wall 20 perpendicularly extending up from an outer diameter 22 of the housing bottom side defining a housing inside 24. The housing inner wall 16 is configured to attach to a ceiling fan 26 between a hub 28 and a fan light 30 of the ceiling fan. Depending on the arrangement of a plurality of fan blades 32 of the ceiling fan relative the hub 28, the light housing 12 may attach directly to the hub 28. There may be an annular housing cover 34 selectively engageable with the housing inner wall 16 and the housing outer wall 20 to seal the housing inside 24 and to provide more surface area to attach to the ceiling fan 26.

A plurality of light blades 36 is coupled to the light housing 12. Each light blade 36 may have an attachment portion 38 and a rectangular extension portion 40. Each light blade 36 may be coplanar and horizontal, rather than pitched like the fan blades 32, for even light distribution. There may be at least five evenly distributed light blades 36. The attachment portion 38 is selectively engageable with the housing bottom side 14 and the extension portion 40 radially extends from the outer diameter 22 of the housing bottom side. The attachment portion 38 may include a plurality of attachment arms 42 perpendicularly extending up from a blade top side 44. The plurality of attachment arms 38 comprises a pair of inner arms 46 and a pair of outer arms 48 to selectively engage the housing inner wall 16 and the housing outer wall 20, respectively, to secure the light blade 36 to the light housing 12. The attachment portion 38 may taper from the outer diameter 22 to the inner diameter 18 of the housing bottom side and may have a rounded inner edge 50 conforming to the inner diameter 18. A pad 52 may be coupled to the blade top side 44 between the attachment arms 38 to prevent intermittent contact and noise from the light blades 36 and light housing 12 from movement while the ceiling fan 26 is operating.

A power supply 54 is coupled to the light housing 12 within the housing inside 24. The power supply 54 may include a first battery box 56 and may alternatively include a wiring harness to receive direct power from the ceiling fan 26. A control switch 58 is coupled to the light housing 12 and is in operational communication with the power supply 54. The control switch 58 may be coupled to the housing outer wall 20. A remote control receiver 60 may be coupled within the housing inside 24 and is in operational communication with the control switch 58. The remote control receiver 60 may include a second battery box 62. A counterweight box 64 may be coupled within the housing inside 24. The counterweight box 64 may be a solid mass or may alternatively be an openable housing to store a plurality of smaller masses to allow the user to adjust the total mass. The first battery box 56, the second battery box 62, and the counterweight box 64 are radially distributed within the housing inside 24 to balance the apparatus 10 such that it sits with the light blades 36 lying in a horizontal plane.

A plurality of LED lights 66 is coupled to the plurality of light blades 36. The plurality of LED lights 66 may comprise a light strip 68 coupled to a blade underside 70 of each light blade and in operational communication with the power supply 54. Each light strip 68 may extend along a medial axis of the extension portion 40 of the light blade for aesthetic and lighting balance. Each light blade 36 may have a wire aperture 72 extending from the blade underside 70 to the blade top side 44 adjacent a proximal end 74 of the light strip 68. A light wire 76 of each light strip extends through the wire aperture 72 to the light housing 12 to connect to the power supply 54. Each light strip 68 may have a pair of semi-obround strip supports 78 to engage the blade underside 70 and to cover the wire aperture 72.

In use, the light housing 12 is attached to the ceiling fan 26. The control switch 58 may serve as a master switch and a remote control 79 or personal electronic device in operational communication with the remote control receiver 60 may be used to toggle the plurality of LED lights 66 on and off for improved illumination in the room. The apparatus 10 may be used independently or in conjunction with the fan light 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ceiling fan light attachment comprising:

a light housing having an annular housing bottom side, a housing inner wall perpendicularly extending up from an inner diameter of the housing bottom side, and a housing outer wall perpendicularly extending up from an outer diameter of the housing bottom side defining a housing inside, the housing inner wall being configured to attach to a ceiling fan between a hub and a fan light of the ceiling fan;

a plurality of light blades coupled to the light housing, each light blade radially extending from an outer diameter of the housing bottom side;

a power supply coupled to the light housing within the housing inside;

a control switch coupled to the light housing and being in operational communication with the power supply; and a plurality of LED lights coupled to the plurality of light blades, the LED lights being coupled to a blade underside of each light blade and being in operational communication with the power supply.

2. The ceiling fan light attachment of claim 1 further comprising each light blade having an attachment portion and a rectangular extension portion, the attachment portion being selectively engageable with the housing bottom side and the extension portion radially extending from the outer diameter of the housing bottom side.

3. The ceiling fan light attachment of claim 2 further comprising the attachment portion including a plurality of attachment arms perpendicularly extending up from a blade top side, the plurality of attachment arms selectively engaging the housing inner wall and the housing outer wall to secure the light blade to the light housing.

4. The ceiling fan light attachment of claim 3 further comprising the plurality of attachment arms comprising a pair of inner arms and a pair of outer arms.

5. The ceiling fan light attachment of claim 1 further comprising the plurality of LED lights comprising a light strip coupled to the blade underside of each light blade, each light blade having a wire aperture extending from the blade underside to a blade top side adjacent a proximal end of the light strip, a light wire of each light strip extending through the wire aperture to the light housing.

6. The ceiling fan light attachment of claim 5 further comprising each light strip extending along a medial axis of an extension portion of the light blade.

7. The ceiling fan light attachment of claim 1 further comprising the power supply including a first battery box; a remote control receiver coupled within the housing inside and in operational communication with the control switch, the remote control receiver including a second battery box; and a counterweight box coupled within the housing inside, the first battery box, the second battery box, and the counterweight box being radially distributed within the housing inside to balance the apparatus.

8. The ceiling fan light attachment of claim 1 further comprising an annular housing cover, the housing cover being selectively engageable with the housing inner wall and the housing outer wall to seal the housing inside.

9. A ceiling fan light attachment comprising:

a light housing having an annular housing bottom side, a housing inner wall perpendicularly extending up from an inner diameter of the housing bottom side, and a housing outer wall perpendicularly extending up from an outer diameter of the housing bottom side defining a housing inside, the housing inner wall being configured to attach to a ceiling fan between a hub and a fan light of the ceiling fan;

an annular housing cover, the housing cover being selectively engageable with the housing inner wall and the housing outer wall to seal the housing inside;

a plurality of light blades coupled to the light housing, each light blade having an attachment portion and a rectangular extension portion, the attachment portion being selectively engageable with the housing bottom side and the extension portion radially extending from the outer diameter of the housing bottom side, the attachment portion including a plurality of attachment arms perpendicularly extending up from a blade top side, the plurality of attachment arms comprising a pair of inner arms and a pair of outer arms selectively engaging the housing inner wall and the housing outer wall, respectively, to secure the light blade to the light housing;

a power supply coupled to the light housing within the housing inside, the power supply including a first battery box;

a control switch coupled to the light housing and being in operational communication with the power supply;

a remote control receiver coupled within the housing inside and in operational communication with the control switch, the remote control receiver including a second battery box;

a counterweight box coupled within the housing inside, the first battery box, the second battery box, and the counterweight box being radially distributed within the housing inside to balance the apparatus; and a plurality of LED lights coupled to the plurality of light blades, the plurality of LED lights comprising a light strip coupled to a blade underside of each light blade and being in operational communication with the power supply, each light strip extending along a medial axis of the extension portion of the light blade, each light blade having a wire aperture extending from the blade underside to the blade top side adjacent a proximal end of the light strip, a light wire of each light strip extending through the wire aperture to the light housing.

10. A ceiling fan light attachment and ceiling fan system comprising:

a ceiling fan having a hub, a plurality of fan blades coupled to the hub, and a fan light coupled to the hub;

a light housing having an annular housing bottom side, a housing inner wall perpendicularly extending up from an inner diameter of the housing bottom side, and a housing outer wall perpendicularly extending up from an outer diameter of the housing bottom side defining a housing inside, the housing inner wall being selectively engageable with the ceiling fan between the hub and the fan light;

an annular housing cover, the housing cover being selectively engageable with the housing inner wall and the housing outer wall to seal the housing inside;

a plurality of light blades coupled to the light housing, each light blade having an attachment portion and a rectangular extension portion, the attachment portion being selectively engageable with the housing bottom side and the extension portion radially extending from the outer diameter of the housing bottom side, the attachment portion including a plurality of attachment arms perpendicularly extending up from a blade top side, the plurality of attachment arms comprising a pair of inner arms and a pair of outer arms selectively engaging the housing inner wall and the housing outer wall, respectively, to secure the light blade to the light housing;

a power supply coupled to the light housing within the housing inside, the power supply including a first battery box;

a control switch coupled to the light housing and being in operational communication with the power supply;

a remote control receiver coupled within the housing inside and in operational communication with the control switch, the remote control receiver including a second battery box;

a counterweight box coupled within the housing inside, the first battery box, the second battery box, and the counterweight box being radially distributed within the housing inside to balance the apparatus; and a plurality of LED lights coupled to the plurality of light blades, the plurality of LED lights comprising a light strip coupled to a blade underside of each light blade and being in operational communication with the power supply, each light strip extending along a medial axis of the extension portion of the light blade, each light blade having a wire aperture extending from the blade underside to the blade top side adjacent a proximal end of the light strip, a light wire of each light strip extending through the wire aperture to the light housing.

* * * * *